US006227414B1

(12) United States Patent
Peronnet et al.

(10) Patent No.: US 6,227,414 B1
(45) Date of Patent: May 8, 2001

(54) DEVICE FOR DISPENSING LIQUID, FLUID OR PASTY PRODUCTS

(75) Inventors: Stanislas Peronnet; Alain Behar, both of Chevilly Larue (FR)

(73) Assignee: LIR France, Chevilly Larue (FR)

( * ) Notice: Subject to any disclaimer, the term of this patent is extended or adjusted under 35 U.S.C. 154(b) by 0 days.

(21) Appl. No.: 09/448,888

(22) Filed: Nov. 29, 1999

(30) Foreign Application Priority Data

Nov. 27, 1998 (FR) ..... 98 14957

(51) Int. Cl.[7] ..... B65D 37/00

(52) U.S. Cl. ..... 222/207; 222/321.6; 222/21.7; 222/341

(58) Field of Search ..... 222/207, 256, 222/257, 260, 320, 321.6, 321.7, 340, 341

(56) References Cited

U.S. PATENT DOCUMENTS 3,507,586 * 4/1970 Gronemeyer et al. ..... 222/207
4,946,076 * 8/1990 Hackmann et al. ..... 222/207
5,125,539 * 6/1992 Schneider ..... 222/144.5
5,267,673 * 12/1993 Crosnier et al. ..... 222/321
5,636,765 * 6/1997 DeJonge ..... 222/107
5,687,884 * 11/1997 Bodin et al. ..... 222/321.7
5,704,519 * 1/1998 Crosnier et al. ..... 222/207
5,788,124 * 8/1998 Bougamont et al. ..... 222/207

* cited by examiner

*Primary Examiner*—Joseph A. Kaufman
*Assistant Examiner*—Patrick Buechner
(74) *Attorney, Agent, or Firm*—Young & Thompson

(57) ABSTRACT

A dispensing device for liquid, fluid or pasty products. A support in an opening of a receptacle encloses the product. The support has a central tubular conduit, a pushbutton axially slidably mounted on the support between a rest position and an active position and a product outlet conduit. An intermediate piece of a resiliently deformable material is between the support and the pushbutton. The intermediate piece and the pushbutton define a measured quantity chamber for the product. The intermediate piece has an opening for communication between the tubular conduit of the support and the measured quantity chamber, and sealingly bears against at least one opening for passage between the measured quantity chamber and the outlet conduit of the pushbutton.

9 Claims, 3 Drawing Sheets

DEVICE FOR DISPENSING LIQUID, FLUID OR PASTY PRODUCTS

The present invention has for its object a device for dispensing liquid, fluid or pasty products, in particular cosmetic products, in the form of measured quantities.

BACKGROUND OF THE INVENTION

Dispensing devices permitting the delivery of products in the form of measured quantities are most often of complicated structure and require a notably high number of pieces such as balls, valves, springs, nozzles and the like.

There has been proposed, by FR-B-2 674 024 and FR-B-2 728 809, devices for dispensing measured quantities suitable for various contents and having a simple structure requiring few pieces.

In FR-B-2 674 024, the device for dispensing measured quantities is constituted by a resiliently deformable flexible member disposed in a rigid cap, this assembly being suitable for a container whose upper portion is of corresponding shape to receive it. When pressure is applied to the cap, a measured quantity of product is isolated and its dispensing is caused whilst producing the reproduction of an identical measured quantity within the assembly.

Thus, this assembly is constituted by this resiliently deformable internal member having an annular portion from which extends a cylindrical skirt defining, with the cap, a measured quantity chamber, the end of the cylindrical skirt of truncated conical shape resting against an annular internal flange of the cap. The internal resilient member also comprises a projection defining the bottom of the measured quantity chamber, mounted on the container, said projection being provided with an opening provided with a flat valve for communication with the interior of the receptacle. When pressure is exerted on the cap, the latter slides axially relative to the container and to the projection mounted on said container and the product enclosed within the measured quantity chamber is subjected to a pressure which closes the flap over the communication opening toward the interior volume of the receptacle and tends to exert a pressure on the walls of the measured quantity chamber. This pressure tends in particular to space the end of the cylindrical skirt from the internal member bearing on the flange of the cap by freeing a passage for the product toward an outlet opening in the cap, the truncated conical shape of the end of the cylindrical skirt facilitating this spacing.

In FR-B-2 728 809, the measured quantity dispensing device is constituted by a pushbutton incorporating a measured quantity chamber traversed centrally by a tube communicating with the outlet opening of the pushbutton and pierced radially at its lower end. This pushbutton is mounted on a suitable support on the neck of a receptacle and within which is mounted axially slidably this pushbutton. A piece of resiliently deformable material is interposed between the support and the pushbutton. This piece comprises an extensible tubular portion closed at its base and within which is emplaced the tube of the pushbutton whilst a peripheral collar of the piece extends over an annular portion of the support it having at least one opening facing the internal volume of the receptacle. The measured quantity chamber is defined between said piece and the pushbutton, the piece being in sealed bearing relationship against the pierced portion of the tube of the pushbutton. When a pressure is exerted on the pushbutton, the latter slides axially relative to the support and deforms the tubular portion of the intermediate piece, the volume of the measured quantity chamber decreases and the product is thus subjected to a pressure which spaces the tubular portion of the intermediate piece from the end of the pushbutton tube where is provided radially an opening. This spacing of the wall permits the evacuation of the product through the tube of the pushbutton in the direction of the outlet opening.

Although these devices have the advantage of requiring few pieces and are thus of an interesting cost, they however have a drawback. Thus, the resiliently deformable walls of the intermediate members act as springs between the support and the pushbutton so as to permit on the one hand the axial sliding of this latter toward a so-called active position of engaging the pushbutton on the support to decrease the internal volume of the measured quantity chamber and, on the other hand, returning said pushbutton to its initial rest position when pressure is no longer exerted on it. It is thus important that the resiliently deformable walls of the intermediate or internal member preserve their properties. However, these walls are principally in contact with the product to be dispensed and there can follow an alteration of the qualities and properties of the resiliently deformable material, leading to poor operation of the dispenser comprising such a dispensing device.

SUMMARY OF THE INVENTION

The object of the invention is therefore to provide a dispensing device for liquid, fluid or pasty products in the form of measured quantities in which an intermediate piece of resiliently deformable material is interposed between a support mounted on a receptacle and a pushbutton so as to interact with them, said piece having a structure suitable to preserve its properties of elasticity whilst being of low cost and easy manufacture.

The present invention thus has for its object a device for dispensing liquid, fluid or pasty products, of the type comprising:

- a support suitable for the opening of a receptacle enclosing the product, said support comprising a central tubular conduit,
- a pushbutton mounted axially slidably on the support between a rest position and an active position, and having a product outlet conduit from a measured quantity chamber for the product of the device and
- an intermediate piece of resiliently deformable material, interposed between the support and the pushbutton and defining with the latter the measured quantity chamber for the product, said intermediate piece having an opening, provided with a closure member, for communication between the tubular conduit of the support and the measured quantity chamber, and being moreover in sealed bearing relationship against at least one opening for passage between the measured quantity chamber and the outlet conduit of the pushbutton, said intermediate piece maintaining the pushbutton in its rest position, characterized in that:

- the support comprises two annular compartments concentric with the tubular conduit and a small collar provided in the tubular conduit at its end opposite its end engaged in the internal volume of a receptacle,
- the pushbutton is constituted by a bottom surrounded by a peripheral skirt axially slidably engaged in the external annular compartment of the support, the outlet conduit of said pushbutton being defined by two concentric skirts projecting from the bottom, at least one outlet opening being provided in the bottom facing said outlet conduit and the passage opening from the measured quantity chamber to the outlet conduit being provided at the end of the innermost concentric skirt, and the intermediate piece having a central cylindrical projection provided with the communication opening which is disposed in bearing relation against the small collar at the end of the tubular conduit of the support, said cylindrical projection being connected to an annular peripheral groove extending in the internal annular compartment of the support surrounding its tubular conduit, said groove comprising a peripheral flange bearing on the wall separating the two annular compartments of the support, the concentric skirts of the pushbutton being moreover disposed in said annular groove, their end resting sealingly against the bottom of the groove, at least the internal wall of the peripheral groove being in sealed bearing relationship against the innermost concentric skirt so as to mask the passage opening between the measured quantity chamber and the outlet conduit, provided at the end of said skirt.

Thus, preferably, the measured quantity chamber is defined between the central cylindrical projection of the intermediate piece, the bottom of the pushbutton, its innermost concentric skirt and the internal wall of the annular groove of the intermediate piece. As a result, one of the walls of the annular groove of the intermediate piece, more particularly the external wall of said groove, is not in contact with the product to be dispensed and there are thus preserved completely the qualities of the material constituting this wall, which cannot undergo alteration because of the product to be dispensed.

In particular, the flange provided at the periphery of the annular groove and said external wall completely play a drive role for the actuation of the dispensing device and maintain their resilient properties intact, which contributes to ensuring a sufficient spring effect for actuation of the pushbutton itself if the rest of the intermediate piece is subject to alterations of its elasticity because of its contact with the product to be dispensed at the level of the measured quantity chamber.

When pressure is exerted on the pushbutton, the latter slides axially relative to the support toward the so-called active position in which it is engaged to the maximum within the support against the action of the intermediate piece and it gives rise to the deformation, which is to say the elongation of the peripheral groove of the intermediate piece, the end of its cylindrical skirts resting against the bottom of said groove. This axial sliding driving of the pushbutton causes the bottom of the pushbutton to approach the central cylindrical projection of the intermediate piece and the volume of the measured quantity chamber decreases. There is thus generated a pressure within the measured quantity chamber which is full of product and this pressure causes the closure of the communication opening of the central cylindrical projection of the intermediate piece with the internal volume of the receptacle, trapping a measured quantity of product in the measured quantity chamber.

There is thus created within the measured quantity chamber a pressure, and the product tends to escape from the measured quantity chamber. The communication opening toward the receptacle being closed, the product exerts a pressure on the walls of the measured quantity chamber and the internal wall of the annular groove of the intermediate piece is thus spaced from the innermost concentric skirt of the pushbutton, which opens the passage opening toward the outlet conduit. The outlet conduit collects the product contained in the measured quantity chamber and said product is guided toward the outlet opening of the pushbutton to the exterior of the dispensing device.

As soon as the pressure exerted on the pushbutton ceases, said pushbutton is automatically returned to its rest position, the deformed intermediate piece tending to recover its original shape, acting as a spring to return said pushbutton to its rest position. The increase of volume of the measured quantity chamber during return of the pushbutton generates a suction of the product from the internal volume of the receptacle, re-establishing a measured quantity of product in the distribution device, ready to be dispensed.

According to a first embodiment, the intermediate piece has portions of different thicknesses, preferably at least the bottom of the annular groove, the peripheral flange and the connection between the central cylindrical projection and the groove being respectively made sufficiently thick to be substantially rigid and little deformable, whilst at least the walls of the annular groove are of a lesser thickness such that, during emplacement of the pushbutton on the support (rest position of the device), the ends of the concentric skirts of the pushbutton will rest on the bottom of the annular groove of the intermediate piece and, during depression of the pushbutton to actuate the dispensing device, said thin walls of the annular groove are axially deformable, which is to say that they can be stretched to give rise to the elongation of the annular groove. The central cylindrical projection can also have a small thickness. The spring action of the intermediate piece and more particularly that of the walls of the annular groove of the intermediate piece which are subject to the action of the concentric skirts of the pushbutton during actuation of the device, is thus increased.

According to another embodiment, the assembly of all of the intermediate piece has identical thickness but these dimensions are such that, during emplacement of said intermediate piece between the support and the pushbutton, when the pushbutton coacts with the support, the intermediate piece is subjected to deformation which leads to different tensions within the intermediate piece, the annular groove being in particular deformed axially under the influence of the outlet conduit of the pushbutton. Preferably, there can thus be controlled in an independent manner the operating loads and the return loads.

Preferably, the intermediate piece is of an elastically deformable material such as an elastomer and, preferably, it is obtained by molding said material.

Preferably, the closure element for the communication opening from the intermediate piece provided at the level of the central cylindrical projection, is made of a single piece with the intermediate piece in the form of a non-return flap. This closure element can also be, as a modification, constituted by a connected piece in the form of a non-return flap or a ball.

BRIEF DESCRIPTION OF THE SEVERAL VIEWS OF THE DRAWINGS

The invention will now be described in greater detail with reference to the accompanying drawing, in which.

DETAILED DESCRIPTION OF THE INVENTION

Figure 1:
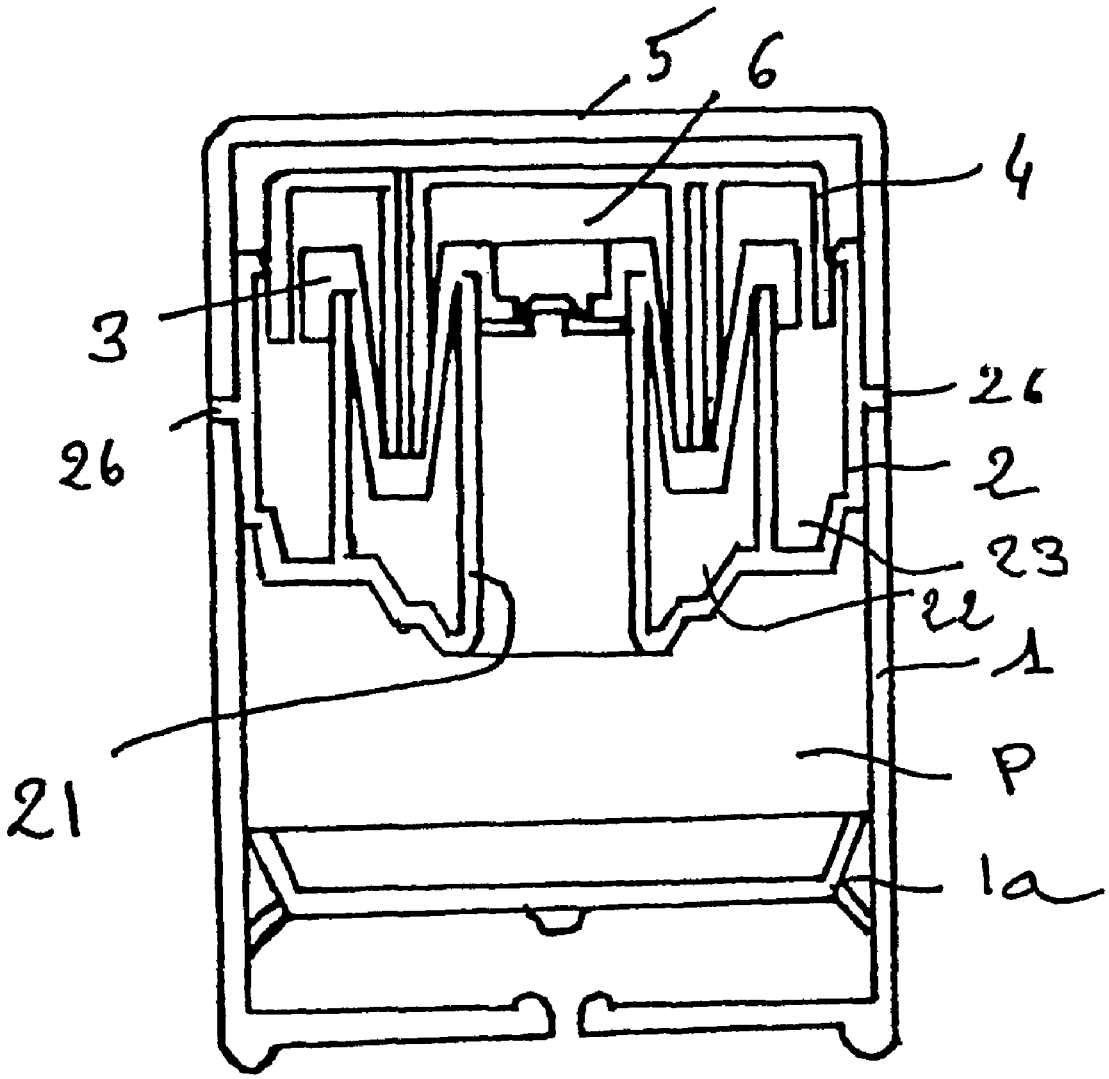
FIG. 1 is a cross-sectional view of a dispenser provided with a dispensing device according to the invention.
Figure 2A:
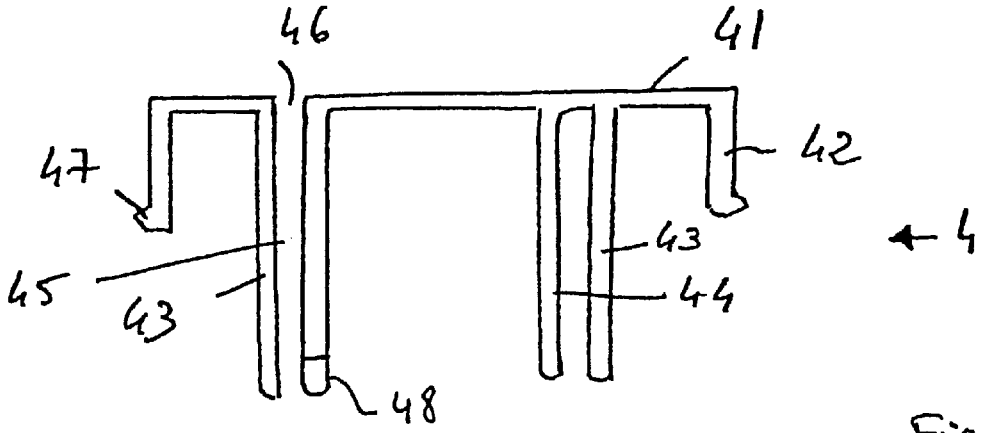
FIGS. 2*a,* 2*b* and 2*c* show respectively a cross-sectional view of the pushbutton, of the intermediate piece and of the support of the device according to FIG. 1.
Figure 2B:
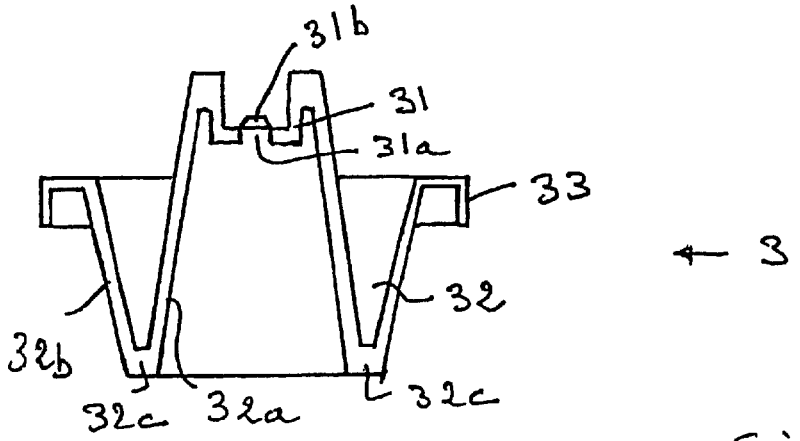
Figure 2C:
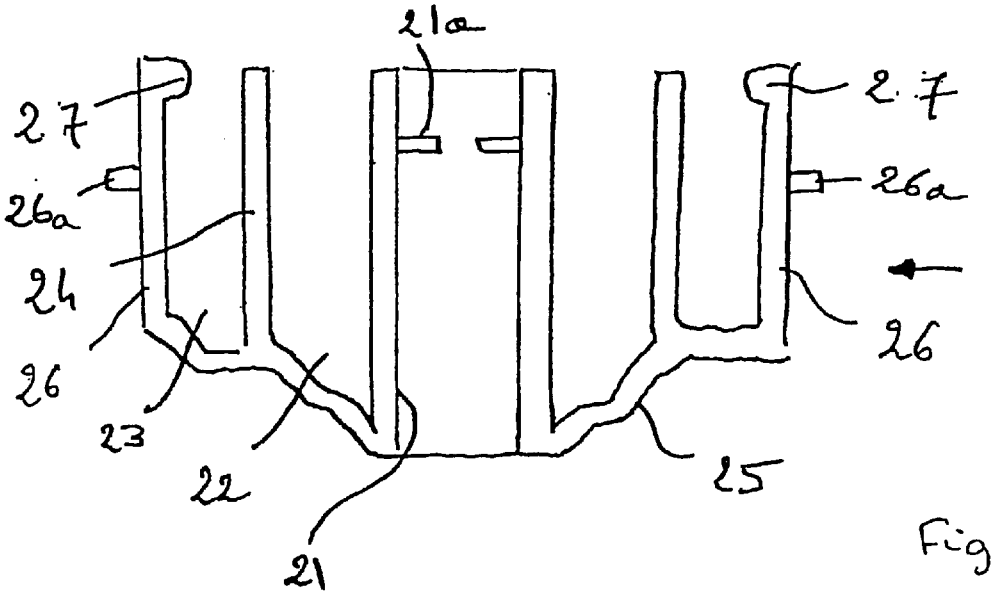

The dispensing device according to the invention is adapted to be mounted in a dispenser of the type comprising a receptacle 1 defining a reservoir for a product P to be delivered. This dispenser of the "airless" type comprises in its bottom a floating piston 1*a*.

On the neck of this receptacle 1 is emplaced the dispensing device according to the invention. The latter comprises a support 2, an intermediate piece 3 and a pushbutton 4. A cap 5 is emplaced on the dispensing device.

The support 2 is of a shape and dimensions complementary to those of the opening of the receptacle 1 and is constituted by a central tubular conduit 21 surrounded by two concentric annular compartments 22 and 23, defined by a wall 24 concentric to the central tubular conduit 21 and projecting from the bottom 25 of the support 2. The tubular conduit 21 constitutes a passage from the internal volume of the receptacle 1 to the exterior of said receptacle 1. The internal compartment 22 is defined between the central tubular conduit 21 and the wall 24 and the external compartment 23 is defined between the wall 24 and the peripheral 26 of said support 2.

The peripheral wall 26 comprises on its external surface a abutment means 26*a* such as a small radially projecting collar adapted to come into contact with the upper edge of the receptacle 1 when the support 2 is introduced into the opening of the receptacle 1, preferably in a sealed manner known per se.

The pushbutton 4 is constituted by a bottom 41 surrounded by a peripheral skirt 42 and provided with two concentric internal skirts 43 and 44 projecting from the bottom 41. These skirts 43 and 44 define an outlet conduit 45 for the product P toward at least one outlet opening 46 provided in the bottom 41 facing said outlet conduit 45.

The outlet conduit 45 is therefore present in the form of an annular space for collecting product P and the outlet opening 46 can be constituted by an annular opening corresponding to said annular space.

The ends of the peripheral skirt 42 are provided with elements projecting radially toward the exterior, such as lugs 47 suitable to come into snap connection below complementary elements provided radially projecting inwardly on the internal surface of the peripheral wall 26 such as a continuous rib 27 of the support 2.

When the lugs 47 are disposed below the continuous rib 27, the peripheral skirt 42 of the pushbutton 4 can then slide axially within the annular external compartment 23 of the support 2 along its peripheral 26, between so-called rest position (see FIG. 1) in which the lugs 47 are in abutment against the rib 27, and an active position when axial pressure is exerted on said pushbutton 4 so as to drive the lugs 47 toward the bottom of the compartment 23. Any other retention means for the pushbutton 4 on the support 2 and permitting its axial sliding, could be used.

Between the support 2 and the pushbutton 4 is installed the intermediate piece 3 made of a resiliently deformable plastic material, for example an elastomer.

This intermediate piece 3 comprises a central cylindrical abutment 31 provided with communication opening 31*a*. This central projection 31 is disposed in bearing relationship against a small collar 21*a* radially projecting within the tubular conduit 21 of the support 2 at the end of said conduit 21 opposite its end within the internal volume of the receptacle 1. This communication opening 31*a* permits a passage of the product P from the internal volume of the receptacle 1 toward the dispensing device. The central projection 31 comprises a closure element for the communication opening 31*a*. This element 31*b* is made of a single piece with the intermediate piece 3 in the form of a non-return flap in the form of a cap.

The central cylindrical projection 31 is connected to an annular peripheral groove 32 comprising an internal wall 32*a*, an external wall 32*b* and a bottom 32*c*, this groove 32 extending within the internal annular compartment 22 of the support 2, said groove 32 comprising a peripheral flange 33 which rests on the separation wall 24 between the two annular compartments 22, 23 of the support 2, the concentric skirts 43, 44 of the pushbutton 4 being disposed within said annular groove 32, therein coming into sealed bearing against the bottom 32*c* of the groove 32 in the rest position of the device according to the invention.

This intermediate piece 3 is thus constituted of a resiliently deformable membrane which, in transverse cross-section as shown in FIG. 1, has a substantially W-shaped cross-section.

A measured quantity chamber 6 is defined within the dispensing device according to the invention, between the intermediate piece 3 and the pushbutton 4. This measured quantity chamber 6 is defined more precisely by the central cylindrical projection 31, the bottom of the pushbutton 4, the internal wall 32*a* of the annular groove 32 and the internal surface of the innermost concentric skirt 44 of the pushbutton 4.

Figure 3:
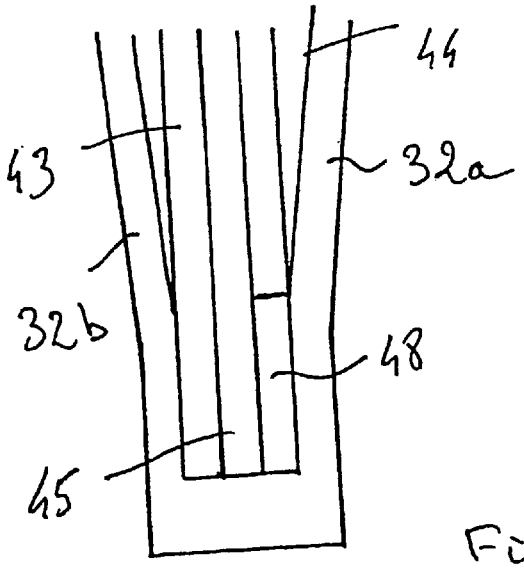
FIG. 3 shows an enlarged cross-sectional view of the bottom of the annular groove of the device according to FIG. 1.

The innermost concentric skirt 44 of the pushbutton 4 has at its end at least one passage opening 48 extending radially over the skirt 44 between the measured quantity chamber 6 of the dispensing device and the outlet conduit 45. This passage opening 48 is sealingly closed by the internal wall 32*a* of the groove 32 as can be seen in FIG. 3. During actuation of the device, the pressure generated within the measured quantity chamber 6 by pushing down the pushbutton 4, gives rise to the spacing of the internal wall 32*a*, which frees the passage for the product through the opening 48 toward the outlet conduit 45.

Preferably, the end of the concentric skirt 44 has crinolations forming a plurality of passage openings against which the internal wall 32*a* of the annular groove 32 comes into sealed bearing.

Preferably, the annular groove 32 is shaped to have a substantially V-shaped cross-section so as to promote the sealed application of the walls 32*a* and 32*b* of said groove 32 against the ends of the concentric skirts 43 and 44.

Figure 4:
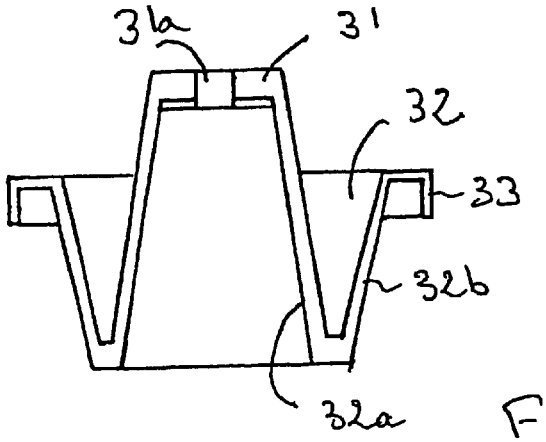
FIG. 4 shows in cross-sectional view a modified embodiment of the intermediate piece of the device according to the invention.

As can be seen in FIG. 4, according to one embodiment, the intermediate piece is molded and has portions of different thicknesses as a function of the tension to be applied to these portions during actuation of the dispensing device. In particular, the central cylindrical projection 31 is in this case adapted to come into bearing against a small collar 21*a* of the central tubular conduit 21 of the support 2, provided at the end of said conduit 21.

Figure 5:
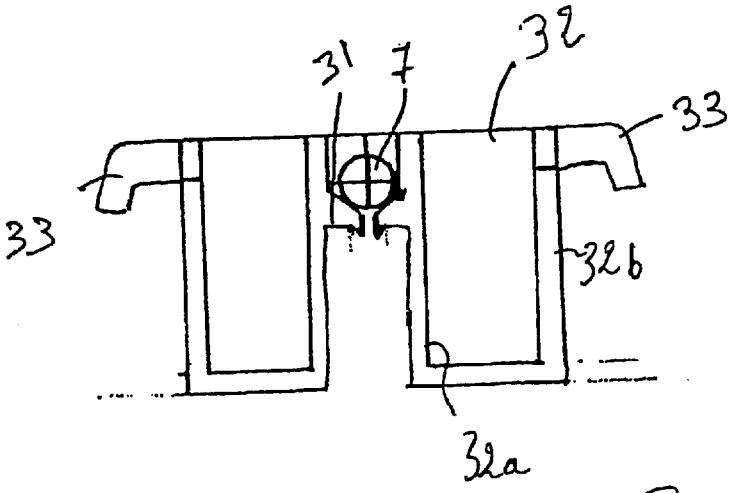
FIG. 5 shows a cross-sectional view of another modified embodiment of the intermediate piece of the device according to the invention.

In FIG. 5, there is shown another embodiment of the intermediate piece 3, in which the intermediate piece is molded so as to have substantially constant thickness throughout and which has dimensions such that, when it is interposed between the support 2 and the pushbutton 4, it is deformed and in particular stretched between said support 2 and the pushbutton 4 so as to coact with the latter (rest position of the device). Thus, the end of the concentric skirts 43 and 44 of the pushbutton 4 press against the bottom 32*c* of the groove 32 such that the walls of the annular groove 32 are stretched under the pressure of the concentric skirts 43 and 44 of the pushbutton 4, in the rest position and during depression of the pushbutton 4.

In this embodiment, the element for closing the communication opening of the central projection 31 with the tubular conduit 21 is constituted by a ball 7.

What is claimed is:

1. A device for dispensing liquid, fluid or pasty products comprising:

a receptacle enclosing the product;

a support in an opening of said receptacle, said support having a tubular central conduit;

a pushbutton axially slidably mounted on said support between a rest position and an active position and having an outlet conduit;

an intermediate piece of a resiliently deformable material, interposed between said support and said pushbutton, said intermediate piece and said pushbutton defining a measured quantity chamber for the product;

an opening in said intermediate piece for communication between the tubular conduit of said support and said measured quantity chamber, said opening having a closure element; and at least one passage opening for passage of said product between the measured quantity chamber and the outlet conduit of the pushbutton, said intermediate piece holding the pushbutton in said rest position, said support having a first and a second annular compartment concentric with and outside said tubular conduit and a collar within said tubular conduit spaced opposite said opening of said receptacle, said pushbutton having a bottom surrounded by a peripheral skirt, said skirt being axially slidably engaged in said second annular compartment, said outlet conduit being defined by an innermost and an outermost concentric skirt projecting from said pushbutton bottom, at least one outlet opening being in said pushbutton bottom and facing said outlet conduit, said passage opening from the measured quantity chamber to the outlet conduit being at an end of said innermost concentric skirt, said opening having a central cylindrical projection bearing against said collar, said cylindrical projection being connected to a peripheral annular groove extending within said first annular compartment and surrounding said tubular conduit, said groove having a peripheral flange bearing against a wall separating said first and said second annular compartments and said second annular compartment, said innermost and said outermost concentric skirts being disposed in said groove, ends of said innermost and said outermost annular compartments resting sealingly against a bottom of said groove, and at least an internal wall of said groove sealingly bearing against said innermost concentric skirt to close said passage opening between the measured quantity chamber and the outlet conduit.

2. The device according to claim 1 wherein said intermediate piece has portions of different thickness, at least the bottom of the groove, the peripheral flange and a connection between the central cylindrical projection and the groove having a first thickness and being rigid and undeformable, and at least walls of the annular groove being a second thickness, less than said first thickness such that, during depression of the pushbutton to actuate the dispensing device, said walls of the groove are axially deformable.

3. The device according to claim 1 wherein said closure element is a non-return flap or a ball connected to said intermediate piece.

4. The device according to claim 1 wherein said intermediate piece is an elastomer.

5. The device according to claim 4 wherein said intermediate piece is molded.

6. The device according to claim 1 wherein said intermediate piece has a constant thickness and dimensions such that, during emplacement of said intermediate piece between the support and the pushbutton, said intermediate piece deforms, resulting in different tensions within said intermediate piece.

7. The device of claim 6, wherein said groove axially deforms under a force of the outlet conduit.

8. The device according to claim 1 wherein said closure element for said opening of said intermediate piece is made of a single piece with said intermediate piece.

9. The device of claim 8, wherein said closure element is a non-return flap.

* * * * *